United States Patent [19]

Takashima

[11] 4,418,979

[45] Dec. 6, 1983

[54] PLUG SOCKET WITH WORKING CONDITION DISPLAY

[75] Inventor: Kiyoshi Takashima, Hikone, Japan

[73] Assignee: Matsushita Electric Works, Ltd., Osaka, Japan

[21] Appl. No.: 339,721

[22] Filed: Jan. 15, 1982

[30] Foreign Application Priority Data

Jan. 21, 1981 [JP] Japan ..... 56-8272

[51] Int. Cl.[3] ..... H01R 3/00

[52] U.S. Cl. ..... 339/113 L

[58] Field of Search ..... 339/113 R, 113 L; 179/53

[56] References Cited

U.S. PATENT DOCUMENTS

| | | | |
|---|---|---|---|
| 2,034,273 | 3/1936 | Smith | 339/113 L |
| 3,196,239 | 7/1965 | Maxted et al. | 200/315 |
| 3,739,226 | 4/1973 | Seiter et al. | 174/53 X |

FOREIGN PATENT DOCUMENTS

| | | | |
|---|---|---|---|
| 369899 | 2/1923 | Fed. Rep. of Germany | 339/113 R |

*Primary Examiner*—Eugene F. Desmond

*Attorney, Agent, or Firm*—Stevens, Davis, Miller & Mosher

[57] ABSTRACT

A plug socket is disclosed which is easy to assemble and which will visually display the working condition of a load connected thereto. The plug socket includes a body having three compartments disposed in a U-shape. In one of the compartments a first blade clip spring member is placed having an integral contact and terminal. In another of the compartments a second blade clip spring member is placed having a contact. A terminal is associated with but separate from the second blade clip spring member in the second compartment. A current transformer is placed in the third compartment. The secondary leads of the current transformer are connected to an electrically luminous element. The primary leads are connected separately to the contact of the second blade clip spring member in the second compartment and its associated terminal, respectively.

2 Claims, 8 Drawing Figures

54
53
51
53
53
4
54
53
3
2
2
1

8a
10b
6
11a
8a
10a
9a
9b
8b
9a
9b
8b
11b
17
49
47
49
18b
18b
12
42b
45
42a
44
43b
27
26
26
45
21
18
15
23a
29
28
25
43a
34
34
35
23b
36
18a
29
21
30a
37
56
32
30b
57
56
55
13c
48
13e
55
19
13a
22
13
13d
52
20
13b
20
33
52

PLUG SOCKET WITH WORKING CONDITION DISPLAY

BACKGROUND OF THE INVENTION

This invention relates to an electrical plug socket which displays a working condition of a load connected to the plug socket.

Plug sockets are known which have a series circuit comprising a neon glow lamp and a limiting resistance between blade clip springs to indicate connection of the plug socket to a working power source. However, these plugs do not indicate whether a load connected to the plug is in working condition, i.e., whether electrical current is passing through the load.

SUMMARY OF THE INVENTION

The claimed invention has been designed to solve the above problem. More particularly, it is an object of the claimed invention to provide a plug socket with a working condition display which is easy to assemble and which displays the working condition of a connected load, even where that load is remote from the plug socket. These objects are accomplished by a unique means combined with a plug socket for indicating the passage of electricity through the load connected to the plug socket.

DETAILED DESCRIPTION OF THE INVENTION

Figure 1:
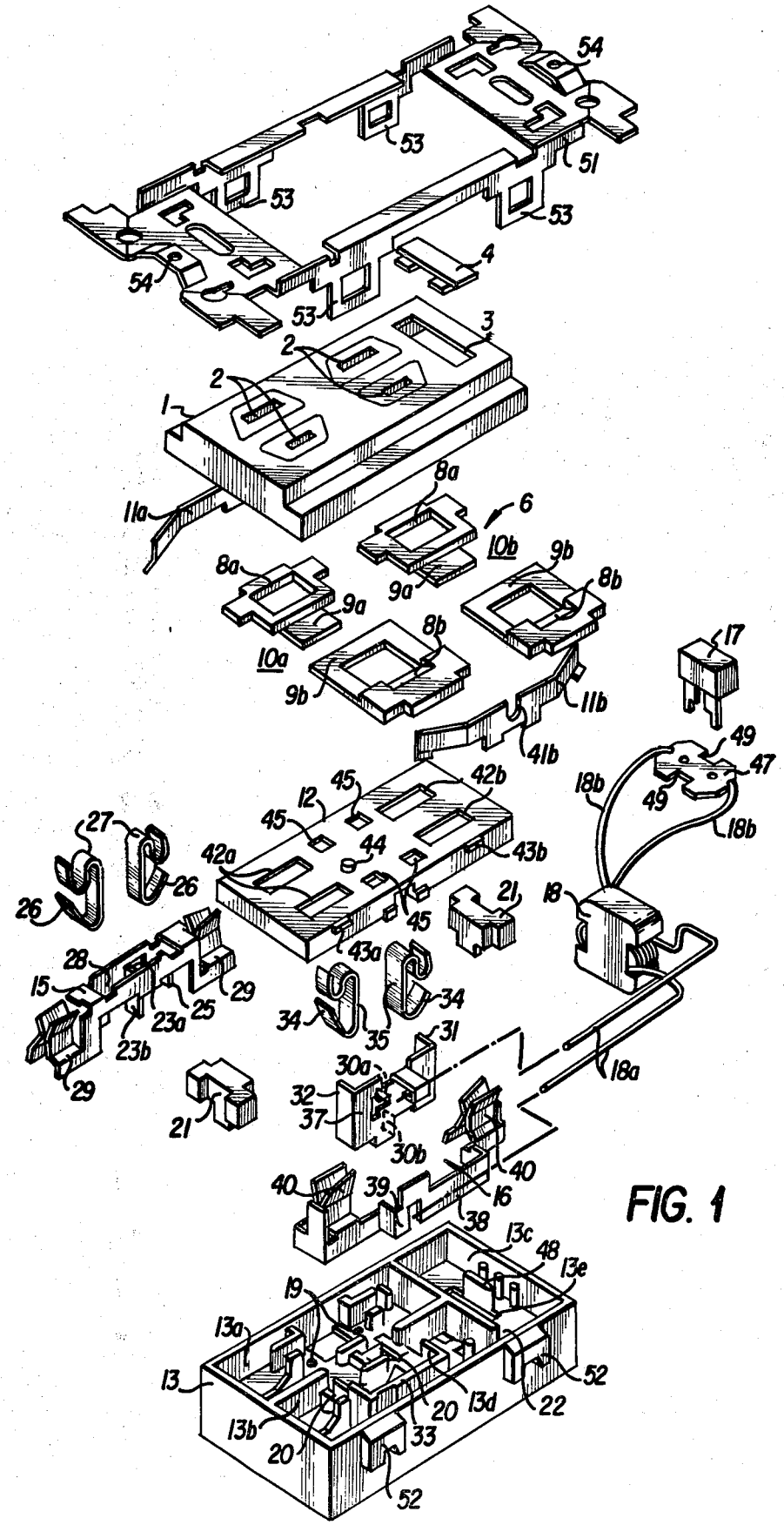
FIG. 1 is an exploded perspective view of the novel plug socket of the claimed invention.
Figure 2:
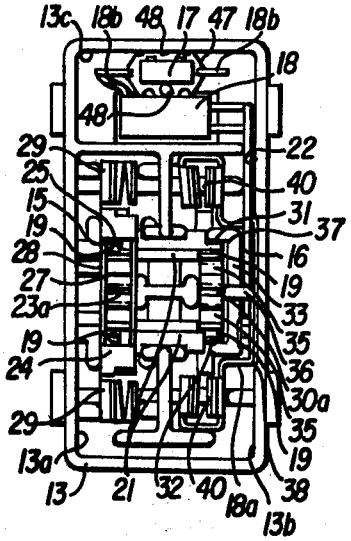
FIG. 2 is a front plan view of the interior of the novel plug socket of FIG. 1.
Figure 3:
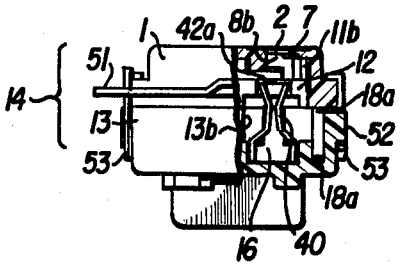
FIG. 3 is a bottom end view, partly in section, of the novel plug socket of FIG. 1.
Figure 4:
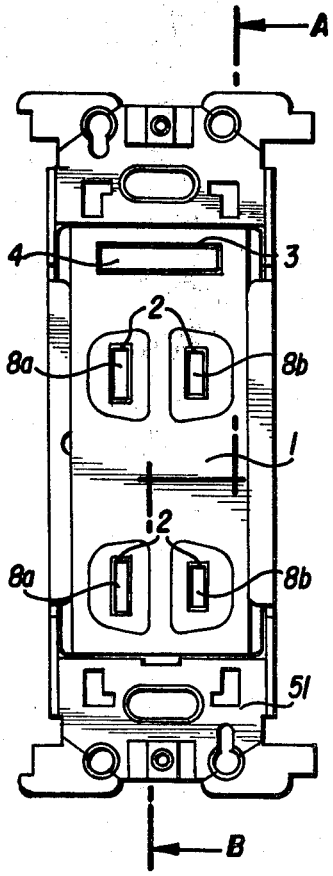
FIG. 4 is a front plan view of the novel plug socket of FIG. 1.
Figure 5:
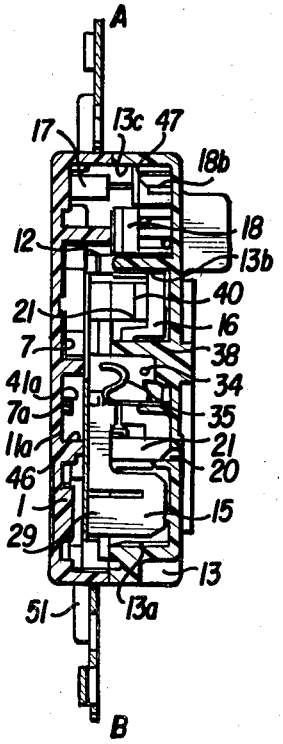
FIG. 5 is a side view in cross section of the novel plug socket of FIG. 4, taken along line A-B of FIG. 4.

An embodiment of the claimed invention will now be detailed with reference to FIGS. 1 through 5. In this embodiment, lid plate 1 has two pairs of plug blade insertion slits 2 and a display window 3 which is covered by a transparent or translucent cover 4 so as to form a light transmitting portion 5. The light transmitting portion 5 alternatively may be formed by thinning out a portion of lid plate 1 to translucency. Again alternatively, the transmitting portion 5 may be molded intergrally with lid plate 1 by injecting transparent synthetic resin into display window 3 and then hardening the injected resin. Door means 6 are fitted in recess 7 of lid plate 1, and comprises pairs of doors, there being one pair of doors associated with each pair of blade insertion slits 2. In the embodiment shown, door means 6 comprises two pairs of doors 10*a*,10*b* having slope portions 8*a*,8*b* and abutments 9*a*, 9*b*. Return springs 11*a*, 11*b* are also fitted in recess 7 of lid plate 1 and bias the doors of respective door pairs 10*a*, 10*b* toward each other. Inner plate 12 secures doors means 6 and return springs 11*a*, 11*b* in recess 7. In each of door parts 10*a*, 10*b*, slope 8*a* corresponds to abutment 9*b*, and slope 8*b* corresponds to abutment 9*a*, so that when a pair of blades (not shown) are inserted into the plug for feeding power to a load, slopes 8*a*, 8*b* of the involved door pairs are simultaneously pushed and the doors open to prevent the occurrence of electric failure caused by insertion of only a single blade.

Body 13 forms a casing 14 in combination with lid plate 1. Body 13 comprises compartments 13*a*, 13*b* for blade clip spring members 15,16, respectively, and a compartment 13*c* for a current transformer 18. The secondary of current transformer 18 is connected to electrically luminous element 17 using a bidirectional diode. In addition, the elecrically luminous element 17 may alternatively be a neon glow lamp or a miniature lamp. Compartments 13*a*, 13*b* and 13*c* are disposed in a U-like shape in body 13. Body 13 includes insertion bores 19; it also includes a pair of insertion slits 20 for insertion of a screw driver for urging a release button 21, there being a release button 21 associated with each insertion slit 20. Compartment 13*b* communicates with compartment 13*c* through a cutout 22.

Blade clip spring member 15 comprises a terminal 28 which has tongues 23*a*, 23*b* cut and raised approximately in alignment from lateral sides and tongues 24, 25 corresponding to the tongues 23*a*, 23*b* at both ends respectively. Blade clip spring member 15 houses two lock springs 27 each having a lock piece portion 26. Lock springs 27 are arranged back to back. Contacts 29 are provided at both ends of terminal 28 and integral therewith. The blade clip spring member 15 is housed within compartment 13*a*. Alternatively, the terminal 28 may be of the screw type and have one or more contacts 29.

Blade clip spring member 16 comprises a terminal 37 which has tongues 30*a*, 30*b* cut and raised approximately in alignment from lateral side and tongues 31, 32 corresponding to the tongues 30*a*, 30*b* at both ends respectively, the tongues 30*a*, 30*b*, 31, 32 being housed in body 13 within a compartment 13*d* partitioned from the compartment 13*b* by use of a wall 33. Two lock springs 35 each having lock piece portions 34 and arranged back to back are also housed within the compartment 13*d*. Terminal 37 has an arm 36 extending toward the compartment 13*b*. Blade clip spring member 16 has contacts 40 which are provided integrally at both ends of a connector 38 which is placed around the wall 33 and has an arm 39 corresponding vertically to the arm 36. Contacts 40 are, of course, separate from the terminal 37 and are housed within compartment 13*b*. Alternatively; the blade clip spring member 16 may be of the screw type and have one or more contacts 40.

Figure 6:
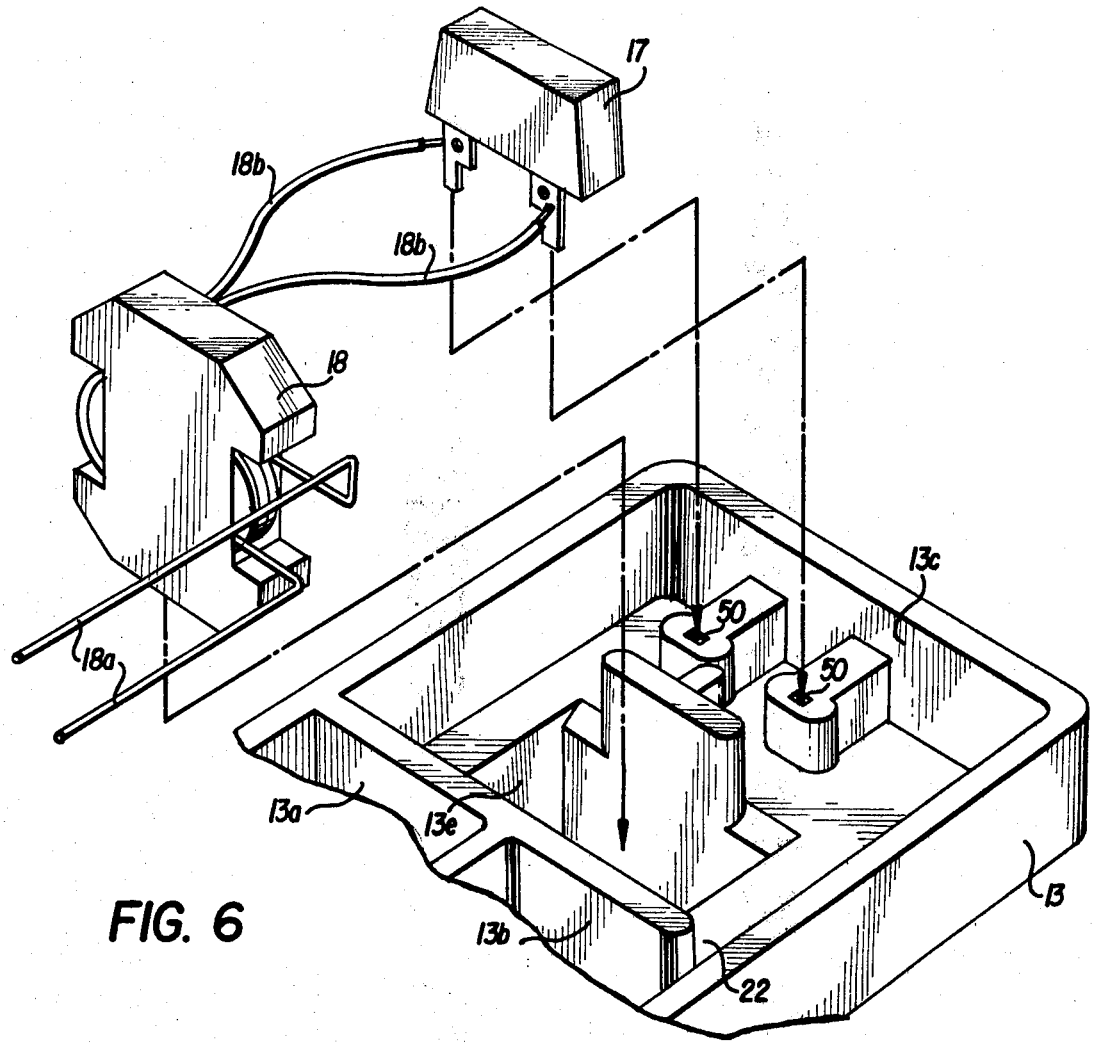
FIG. 6 is an exploded perspective view of the display means portion of the novel plug socket of FIG. 1.

An assembly of the plug socket of the claimed invention will be described in order. Return springs 11*a*, 11*b* are first placed at their respective sides of recess 7 of lid plate 1 through cutouts 41*a*, 41*b* engaging projections 7*a* of recess 7. Door means 6 are placed in recess 7 and biased by return springs 11*a*, 11*b* so that the slopes 8*a*, 8*b* of each door pair closes its respective plug blade insertion slits 2. Inner plate 12 having projections 43*a*, 43*b* engageable with recess 7 is then fitted therein. Projections 44 for anti-reverse assembly and bores 45 are provided in inner plate 12. Cavity 46 for escaping the wire is provided. Release buttons 21 are then inserted in body 13, blade clip spring member 15 is housed in compartment 13*a*, and lock springs 27 with lock piece portions 26 are inserted into blade clip spring member 15 opposite to tongues 24, 25, each lock spring 27 being adjacent to its respective release button 21. Next, the terminal 37 and contacts 40, i.e., the blade clip spring member 16, are connected to the primary of current transformer 18 at arms 36, 39 respectively, by soldering wires 18*a* from the primary of current transformer 18. The current transformer 18 is fitted into a recess 13*e* in compartment 13*c*; the terminal 37 and contacts 40 are housed within compartments 13*d*, 13*d* respectively. In this instance, since the primary leads 18*a*, which pass through cutout 22, are spaced vertically from one another at a regular interval by arms 36,39 an appropriate insulating distance can be ensured even if bare wires are used. Where covered wires are used, arms 36, 29 are not necessary, so that the wires may be connected by soldering directly with terminal 37 and contacts 40. Electrically luminous element 17 is mounted on a substrate 47 and connected with the secondary wires 18*b* of current transformer 18, the substrate 47 engaging at its cutouts 49 with projections 48 at compartment 13*c*, thereby securing the electrically luminous element 17 within compartment 13*c*. Alternatively, the elctrically luminous element 17, as shown in FIG. 6, may be inserted into bores 50 formed in compartment 13*c*. Mounting frame 51 has lugs 53 which fit tightly over projections 52 at both sides of body 13 to assemble the casing 14. Mounting frame 51 is used when the casing 14 is embedded in a structural material. Bores 54 may be added for mounting a front plate (not shown). In open wiring, mounting frame 51 is unnecessary and casing 14 may be assembled by screws or the like.

Figure 8:
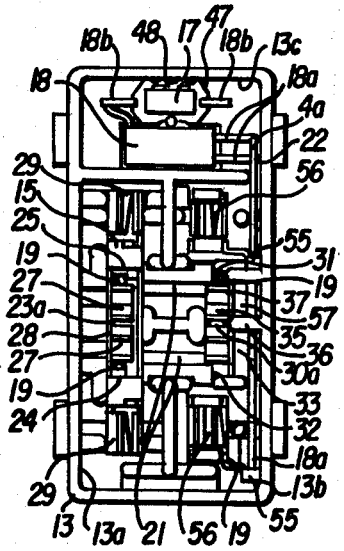
FIG. 8 is a front plan view of the interior of the novel plug socket of FIG. 7.
Figure 7:
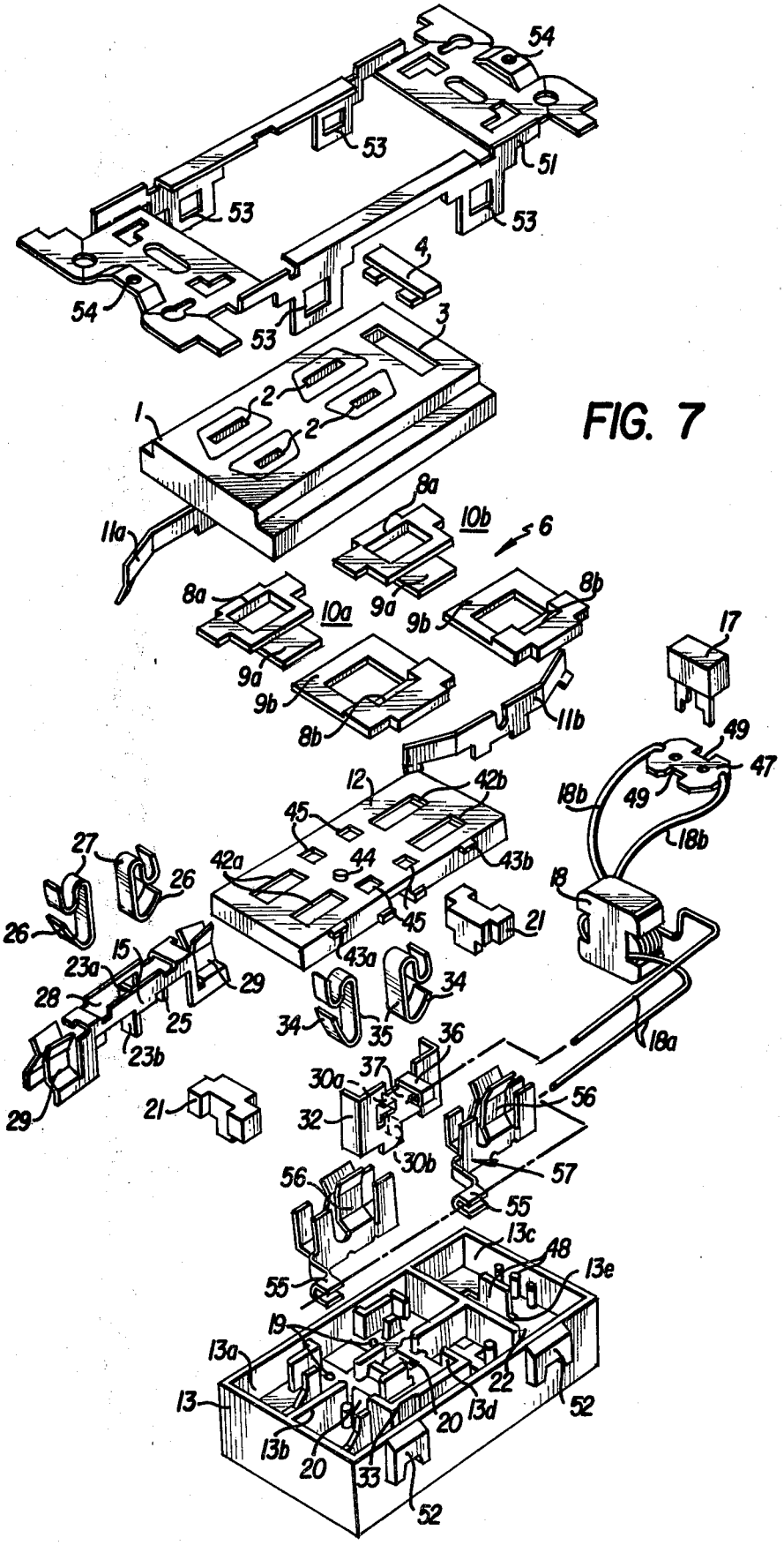
FIG. 7 is an exploded perspective view of another embodiment of the novel plug socket of the claimed invention.

FIGS. 7 and 8 show a second embodiment of the claimed invention, having a terminal 37 which has an arm 36. However, each contact 56 is formed with a clip 55 to form separate blade clip spring members 57, thereby making it possible to employ less material.

the plug socket of the claimed invention thus comprises a lid plate 1 having plug blade insertion slits 2 and a light transmitting portion 5; a body 13 which forms a casing 14 in combination with lid plate 1 and which has compartment 13*a* ,13*b* for the pair of blade clip spring members 15, 16 and compartment 13*c* for current transformer 18 connecting at its secondary with an electrically luminous element 17. The compartments 13*a* ,13*b* ,13*c* are arranged in a U-like shape, the compartment 13*b* for one blade clip spring member 16 connecting with compartment 13*c* for the current transformer 18 through a cutout 22. One blade clip spring member 15 includes a terminal 28 and contacts 29 integral therewith and the other blade clip spring member 16 includes contacts 40 and there is a terminal 37 separate from said contacts 40. The primary of the current transformer 18 is connected to the terminal 37 associated with the second blade clip spring member 16 and the contacts 40 thereof. Hence, the plug socket of the invention displays a load working condition, enables visual confirmation for the working condition of a remote load, and is easy to assemble. Leading wires 18 through cutout 22 is advantageous because compartment 13*b* for blade clip spring 16 connects with compartment 13*c* for current transformer 18 through cutout 22. Furthermore, the blade clip spring members 15, 16 are separate from current transformer 18, so that the plug socket of the claimed invention is free from deterioration caused by repeated insertion and removal of plugs. Also, as seen from the second embodiment of the claimed invention, the blade clip spring member 16 comprises terminal 37 and separate contacts 56 each having a wire clip 55, thereby reducing material use. furthermore, the contact may be increased in number to thereby obtain a plug socket for several plugs.

What is claimed is:

1. A plug socket with working condition display comprising:

a main body, divided into first, second and third compartments, said compartments arranged in the shape of a U, said second and third compartments being connected by a cutout;

a first blade clip spring member placed in said first compartment, said first blade clip spring member including a terminal and a contact member;

a second blade clip spring member placed in said second compartment, said second blade clip spring member including a contact member;

a terminal associated with but separate from said second blade clip member;

a current transformer placed in said thid compartment and having primary and secondary leads;

an electrically luminous element connected to the secondary leads of said current transformer;

one of said primary leads of said current transformer being connected to said terminal associated with but separate from said second blade clip member;

the other of said primary leads of said current transformer being connected to the contact of said second blade clip member;

both of said primary leads passing through said cutout;

a lid plate engageable with said main body to form a casing, said lid plate including a pair of plug blade insertion slits complementary to said first and second blade clip spring members and a light transmitting portion designed to permit the transmission of light from said electrically luminous element, whereby said plug socket will visually indicate the working condition of a load connected to said plug socket.

2. The plug socket of claim 1, wherein said second clip spring member includes a first arm and said terminal associated with but separate from said second clip spring member includes a second arm, said arms so disposed as to space the primary leads of said current transformer from each other.

* * * * *